US007051877B2

(12) United States Patent
Lin

(10) Patent No.: US 7,051,877 B2
(45) Date of Patent: May 30, 2006

(54) NAPKIN CONTAINER HAVING OPENABLE AND SEALABLE COVER

(76) Inventor: Pai Yung Lin, P.O. Box 10-69, Chong Ho, Taipei (TW) 235

( * ) Notice: Subject to any disclaimer, the term of this patent is extended or adjusted under 35 U.S.C. 154(b) by 0 days.

(21) Appl. No.: 10/294,155

(22) Filed: Nov. 12, 2002

(65) Prior Publication Data

US 2004/0089578 A1 May 13, 2004

(51) Int. Cl.
*B65H 1/00* (2006.01)
*B65D 43/00* (2006.01)

(52) U.S. Cl. ..... 206/494; 206/233; 383/211

(58) Field of Classification Search ..... 220/836, 220/837, 839, 845, 847; 206/233, 494, 470; 383/211; 229/125.36, 125.15, 125.13, 125.01
See application file for complete search history.

(56) References Cited

U.S. PATENT DOCUMENTS 4,723,301 A * 2/1988 Chang ..... 383/66
5,048,718 A * 9/1991 Nakamura ..... 221/35
6,026,953 A * 2/2000 Nakamura et al. ..... 206/233
6,616,334 B1 * 9/2003 Faaborg et al. ..... 383/211

* cited by examiner

*Primary Examiner*—David T. Fidel

(57) ABSTRACT

A napkin container includes an opening formed in one surface, and a cover device having a peripheral frame secured onto the container and having a pivotal cover adhesive onto the container for blocking the opening of the container. The cover may be solidly secured onto the container in a water-tight seal after the cover has been opened, for preventing the wetted napkins from being quickly dried. The cover device may be quickly manufactured with a planar or flat sheet material. A panel may further be secured to the cover for engaging into the opening of the container.

2 Claims, 6 Drawing Sheets

NAPKIN CONTAINER HAVING OPENABLE AND SEALABLE COVER

BACKGROUND OF THE INVENTION

1. Field of the Invention

The present invention relates to a napkin container, and more particularly to a container for receiving the wetted napkin and having an openable and sealable cover.

2. Description of the Prior Art

Typical containers for receiving the napkins, particularly the wetted napkins, include a water-tight sealing construction for preventing the wetted napkins from being quickly dried, and include a cover for enclosing an opening thereof that may be used for pulling or fetching the wetted napkins out of the container one by one.

However, after use or after the cover of the typical napkin containers has been opened relative to the containers, the cover may be easily disengaged from the container, and may not be engaged onto the container in the water-tight sealing construction again, such that the wetted napkins may be quickly dried after use.

For suitably sealing the typical napkin containers after the typical napkin containers have been opened, a complicated cover may be provided for enclosing or sealing the typical napkin containers again after being opened. However, the complicated cover is expensive and may not be easily manufactured.

The present invention has arisen to mitigate and/or obviate the afore-described disadvantages of the conventional napkin containers.

SUMMARY OF THE INVENTION

The primary objective of the present invention is to provide a napkin container including an openable and sealable cover that may be easily manufactured with a planar or flat sheet material, in mass production.

The other objective of the present invention is to provide a napkin container including an openable and sealable cover that may be firmly engaged with the container in a water-tight seal after being opened, for preventing the wetted napkins from being quickly dried.

The further objective of the present invention is to provide a napkin container including a cover solidly and pivotally secured to a peripheral frame for allowing the cover to be opened and closed without being disengaged from the peripheral frame.

In accordance with one aspect of the invention, there is provided a napkin container comprising a container body including a surface having an opening formed therein, a cover device including a peripheral frame secured onto the surface of the container body, and including a chamber formed in the peripheral frame, and including a cover pivotally secured to the peripheral frame with a living hinge and engageable into the chamber of the peripheral frame to block the opening of the container body, and disengageable from the chamber of the peripheral frame for opening the opening of the container body, and an adhesive material applied onto the cover for detachably and openably securing the cover to the surface of the container body, and for openably blocking the opening of the container body. The cover may be solidly or firmly secured onto the surface of the container body in a water-tight seal after the cover has been opened, for preventing the wetted napkins from being quickly dried. The cover device may be easily and quickly manufactured with a planar or flat sheet material.

The peripheral frame includes a notch formed therein and opposite to the living hinge, and the cover includes an ear extended therefrom and engageable into the notch of the peripheral frame.

The peripheral frame includes at least one recess formed therein, and the cover includes at least one projection extended therefrom and engageable into the recess of the peripheral frame for reducing stress concentration effect.

For example, the peripheral frame includes a first side having the recess formed therein for receiving the projection of the cover, the living hinge is provided between the cover and the first side of the peripheral frame.

A panel may further be provided and secured onto the cover with the adhesive material for blocking the opening of the container body. The panel includes a shape or an area corresponding to that of the opening of the container body, for engaging into the opening of the container body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
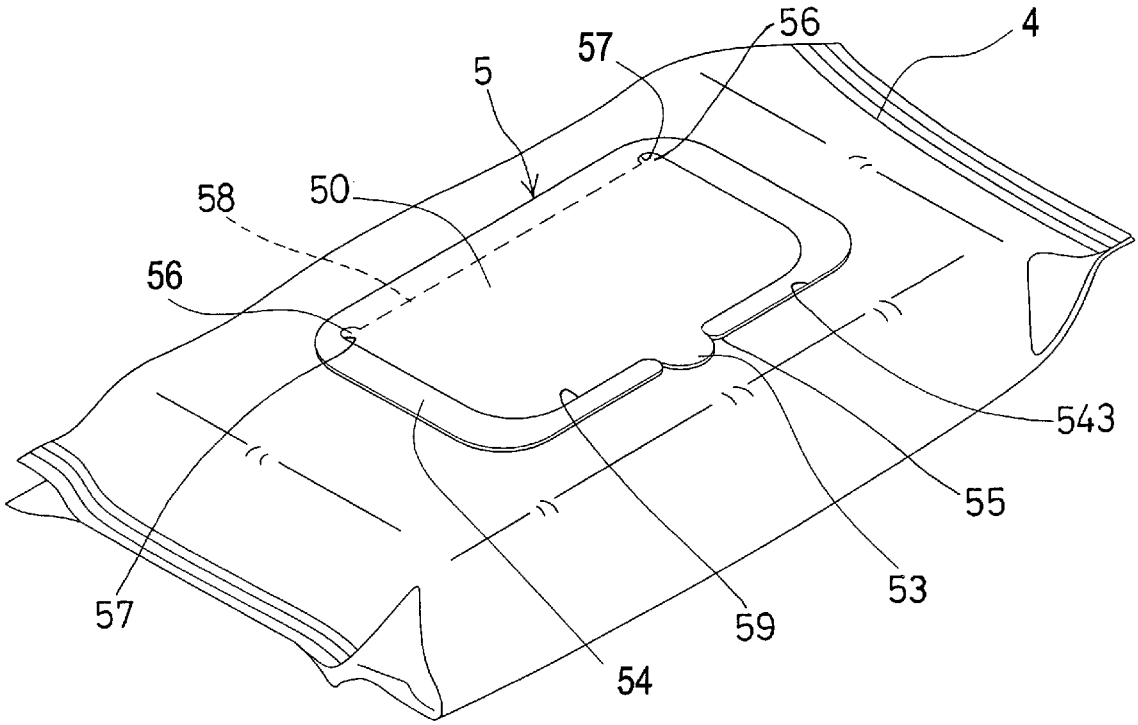
FIG. 1 is a perspective view of a napkin container in accordance with the present invention, having a cover device in a close condition or position.

Referring to the drawings, and initially to FIGS. 1–4, a napkin container in accordance with the present invention comprises a container body 4 for receiving napkins, particularly the wetted napkins 70 therein. The container body 4 includes an opening 41 formed therein, such as formed in one or upper surface 42 thereof for fetching or pulling the napkins 70 out of the container body 4 one by one.

A cover device 5 is provided for openably blocking or sealing the opening 41 of the container body 4, and may be formed with a planar or flat sheet member or material, and includes a cover 50 formed or received in a space or chamber 59 formed or defined within a peripheral frame 54. Relatively, the peripheral frame 54 includes a chamber 59 formed therein for receiving the cover 50.

The cover 50 is pivotally secured to one side, such as the rear side 541 of the peripheral frame 54 with such as a folding line or a living hinge 58 which may be formed in the cover device 5 or formed between the cover 50 and the peripheral frame 54 by a pressing process or the like, for allowing the cover 50 to be rotated relative to the peripheral frame 54 about the living hinge 58.

The rear side 541 of the peripheral frame 54 includes one or more recesses 57 formed therein and communicating with the chamber 59 thereof. The cover 50 includes one or more projections 56 extended therefrom and engaged or formed within the corresponding recesses 57 of the rear side 541 of the peripheral frame 54, for reducing the stress concentration effect that may be occurred by the cover 50 against the peripheral frame 54.

The cover device 5 may include a notch 55 formed therein, such as formed in the front side 543 of the peripheral frame 54, opposite to or distal to the living hinge 58 of the cover device 5. The cover 50 may further include an ear 53 extended therefrom and engageable into the notch 55 of the peripheral frame 54.

Figure 5:
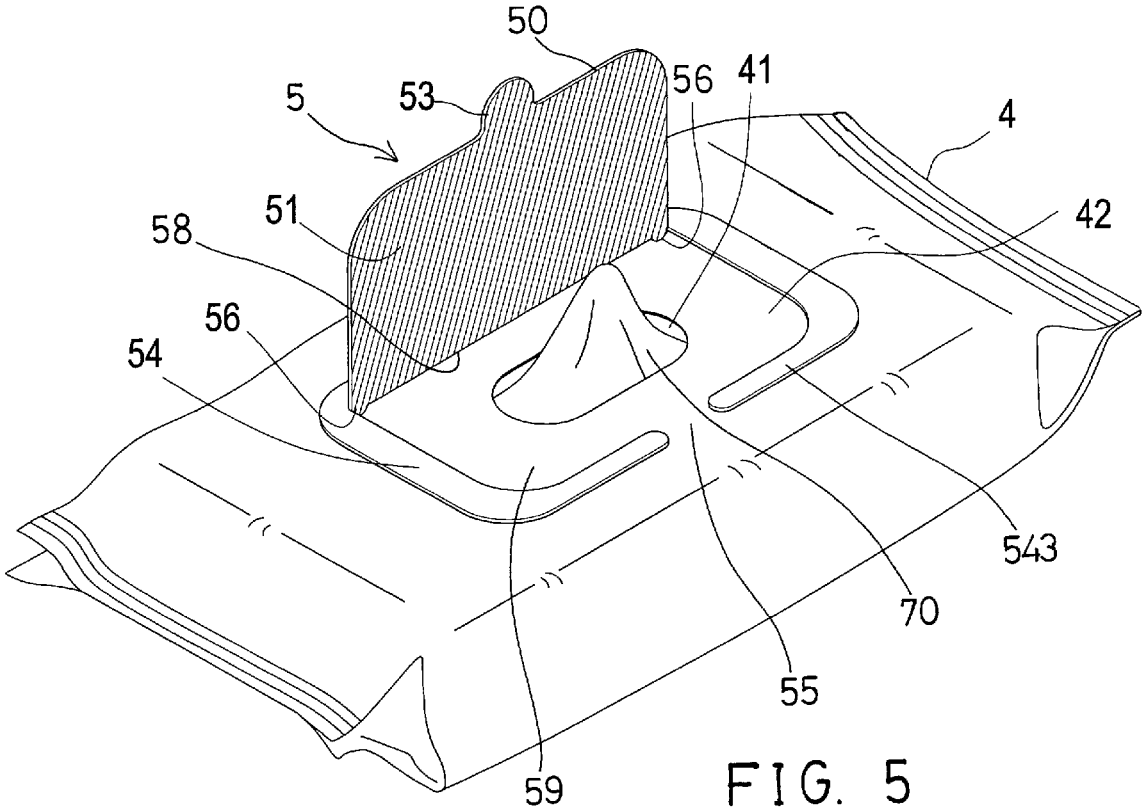
FIG. 5 is a perspective view illustrating the operation of the napkin container.

The cover 50 includes an adhesive layer or material 51 applied thereon, such as applied onto the inner surface thereof (FIG. 5) for adhering onto the a upper surface 42 of the container body 4 in a watertight seal, and for suitably blocking or sealing the opening 41 of the container body 4.

A panel 52 may further be provided and secured onto the inner surface of the cover 50 with such as the adhesive material or layer 51, and has a shape or area corresponding to or equal to or slightly smaller than that of the opening 41 of the container body 4, for engaging into the opening 41 of the container body 4, and for further suitably blocking or sealing the opening 41 of the container body 4. The panel 52 may further be provided for preventing the adhesive layer 51 from being wetted by the wetted napkins 70.

Figure 6:
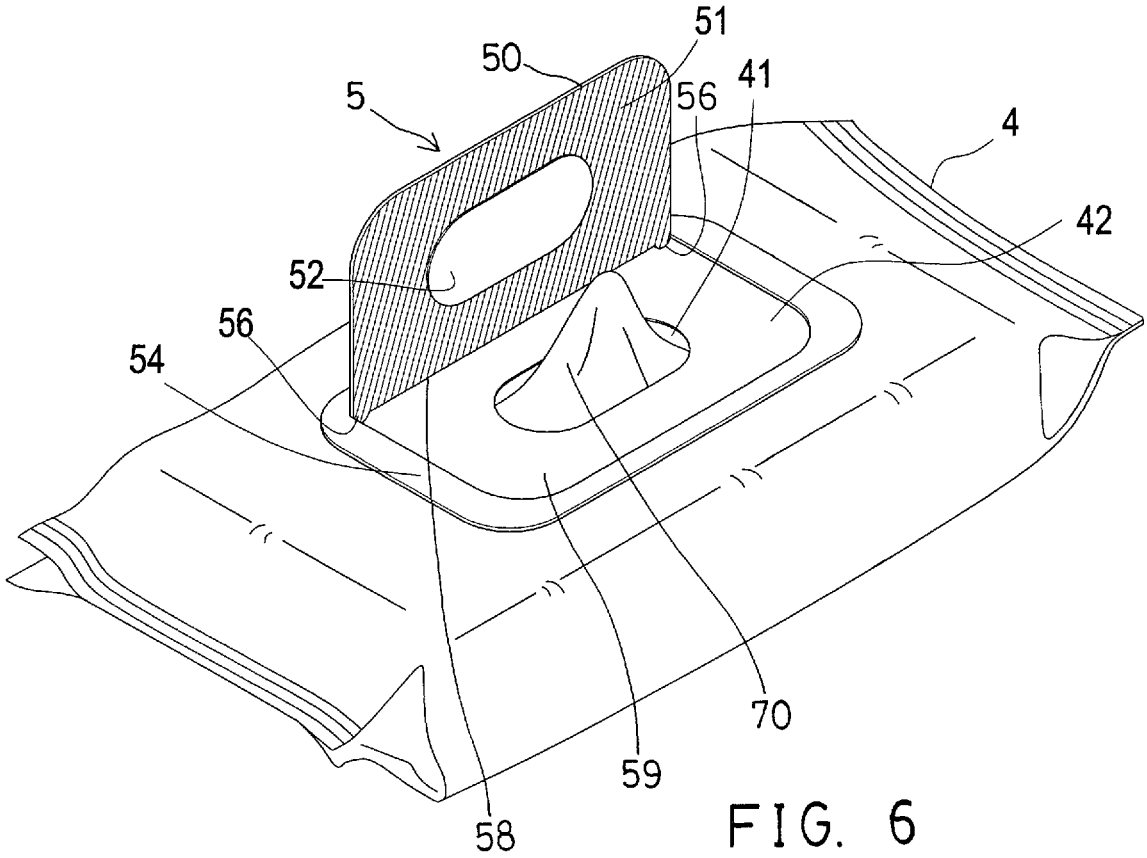
FIG. 6 is a perspective view illustrating the other arrangement or application of the napkin container.

Referring next to FIG. 6, the peripheral frame 54 of the cover device 5 may include no notch 55 formed or provided therein, and the cover 50 may include no ear 53 extended therefrom. The cover 50 may also be engaged or received in the chamber 59 of the cover device 5, for adhering onto the upper surface 42 of the container body 4 again and again with the adhesive layer 51.

Figure 2:
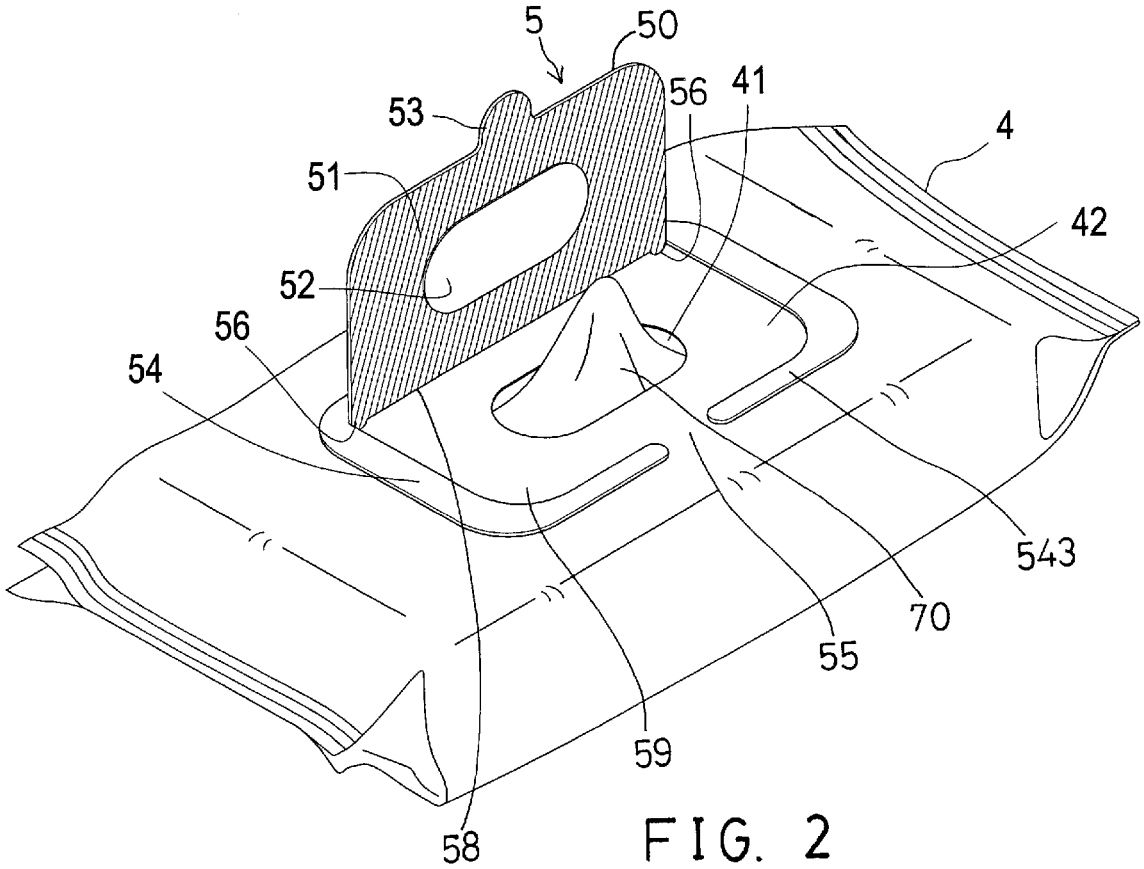
FIG. 2 is a perspective view of the napkin container, in which the cover device of the napkin container is in an open condition or position.
Figure 3:
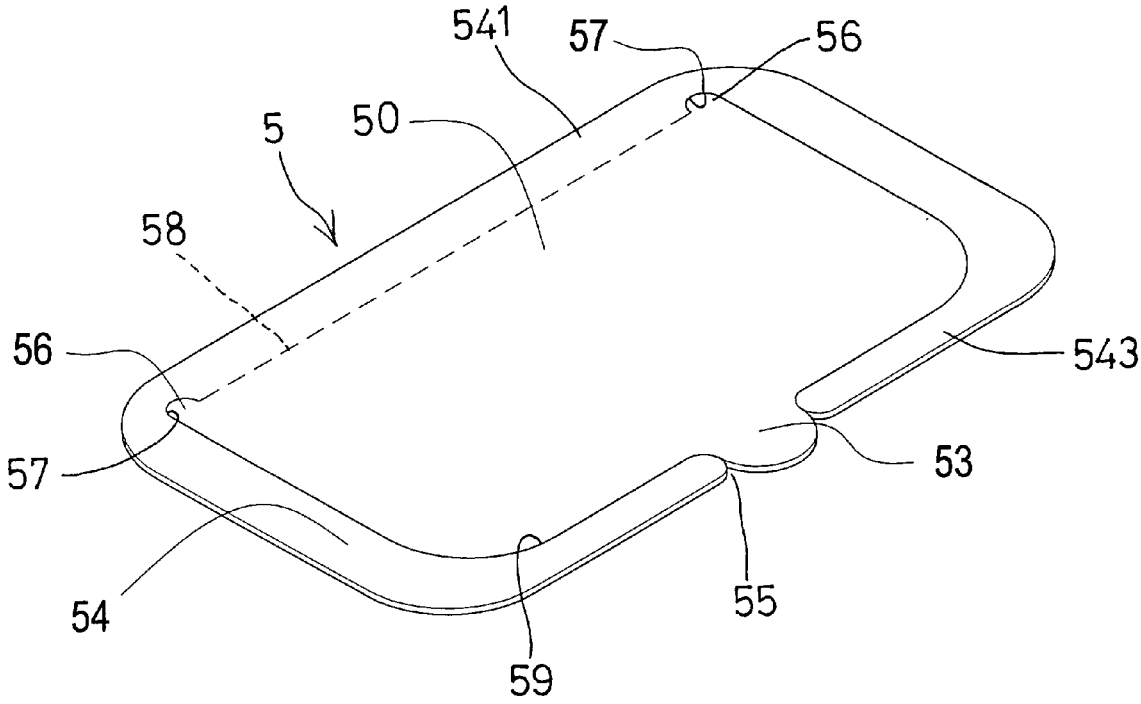
FIG. 3 is a perspective view of the cover device of the napkin container which is in the close condition or position.
Figure 4:
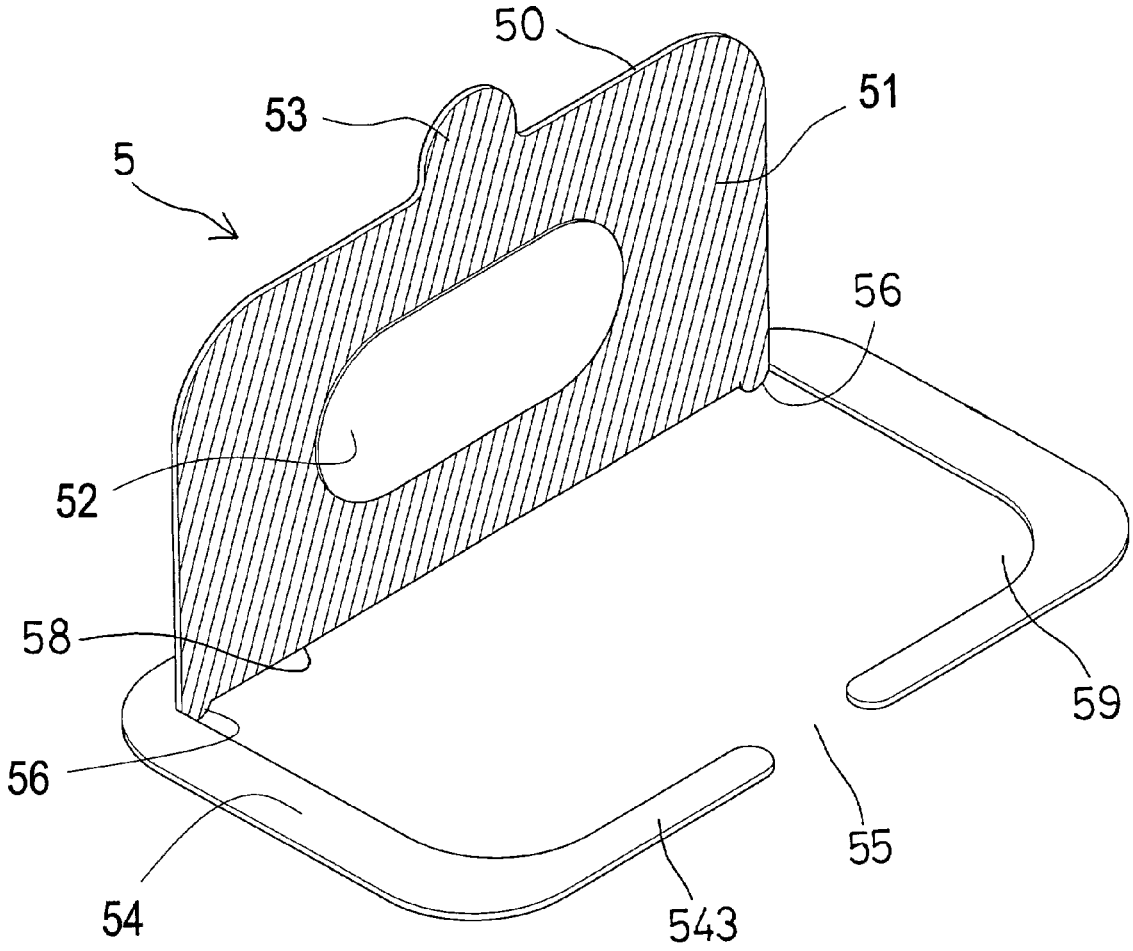
FIG. 4 is a perspective view of the cover device of the napkin container which is in the open condition or position.

In operation, as shown in FIGS. 1 and 2, the cover 50 may be opened and adhered onto the upper surface 42 of the container body 4 again with the adhesive layer 51 in order to suitably block or seal the opening 41 of the container body 4 in a water-tight seal, for preventing the wetted napkins 70 from being quickly dried.

In addition, the cover 50 may be solidly secured to the peripheral frame 54 with the living hinge 58, and thus will not be disengaged from the peripheral frame 54. Furthermore, the cover device 5 may be easily and quickly formed or manufactured with a planar or flat sheet material, such that the cover device 5 is good for being made in mass production.

Accordingly, the napkin container in accordance with the present invention includes an openable and sealable cover that may be easily manufactured with a planar or flat sheet material, in mass production, and that may be firmly engaged with the container in a water-tight seal after being opened, for preventing the wetted napkins from being quickly dried, and that may be solidly and pivotally secured to a peripheral frame for allowing the cover to be opened and closed without being disengaged from the peripheral frame.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A napkin container comprising: a container body including a surface having an opening formed therein, a cover device including a peripheral frame secured onto said surface of said container body, and including a chamber formed in said peripheral frame, and including a cover pivotally secured to said peripheral frame with a living hinge and engageable into said chamber of said peripheral frame to block said opening of said container body, and disengageable from said chamber of said peripheral frame for opening said opening of said container body, and an adhesive material applied onto said cover for detachably and openably securing said cover to said surface of said container body, and for openably blocking said opening of said container body;

the surface having a long side and a short side; and the cover having a long side approximately parallel to the long side of the surface and a short side approximately parallel to the short side of the surface; the living hinge being at the long side; and the peripheral frame having a long side approximately parallel to the long side of the surface and a short side approximately parallel to the short side of the surface;

wherein said peripheral frame includes a notch along a long side of the periphery frame; and opposite to said living hinge, and said cover includes an ear extended therefrom and engageable into said notch of said peripheral frame;

wherein said peripheral frame includes at least one recess formed therein, and said cover includes at least one projectoin extended therefrom and engageable into said at least one recess of said peripheral frame for reducing stress concentration effect;

wherein said peripheral frame includes a first side having said at least one recess formed therein for receiving said at least one projection of said cover, said living hinge is provided between said cover and said first side of said peripheral frame;

further comprising a panel secured onto said cover with said adhesive material for blocking said opening of said container body.

2. The napkin container according to claim 1, wherein said panel includes a shape corresponding to that of said opening of said container body, for engaging into said opening of said container body.

* * * * *